United States Patent [19]

Reim et al.

[11] Patent Number: 4,553,659

[45] Date of Patent: Nov. 19, 1985

[54] INSERTION APPARATUS

[75] Inventors: Werner Reim, Waldbronn; Dieter Plüschow, Stutensee-Friedrichstal, both of Fed. Rep. of Germany

[73] Assignee: IWK Verpackungstechnik GmbH, Stutensee, Fed. Rep. of Germany

[21] Appl. No.: 377,369

[22] Filed: May 12, 1982

[30] Foreign Application Priority Data

May 14, 1981 [DE] Fed. Rep. of Germany ..... 3119081

[51] Int. Cl.[4] ..... B65G 47/46

[52] U.S. Cl. ..... 198/372; 198/476.1; 198/598; 198/719; 198/456; 53/252

[58] Field of Search ..... 198/365, 372, 456, 440, 198/449, 598, 719, 482, 483, 484; 53/252

[56] References Cited

U.S. PATENT DOCUMENTS

| | | | |
|---|---|---|---|
| 1,206,901 | 12/1916 | Paridon | 53/252 X |
| 3,231,061 | 1/1966 | Borkmann | 198/482 X |
| 3,333,396 | 8/1967 | Paal et al. | 53/252 |
| 3,771,648 | 11/1973 | Revuelta | 198/440 X |
| 3,791,518 | 2/1974 | Vanderhoof | 198/440 X |

FOREIGN PATENT DOCUMENTS

| | | | |
|---|---|---|---|
| 2930150 | 3/1981 | Fed. Rep. of Germany | 53/252 |
| 55-48118 | 4/1980 | Japan | 198/372 |
| 650135 | 2/1951 | United Kingdom | 53/252 |

*Primary Examiner*—Joseph E. Valenza
*Assistant Examiner*—Jonathan D. Holmes
*Attorney, Agent, or Firm*—Sandler & Greenblum

[57] ABSTRACT

An insertion apparatus is provided for inserting continuously supplied products into containers. The insertion apparatus includes an ejection device which moves parallel to products along an endless conveyor system, and a curved directrix which is adapted to guide the ejection device in a direction which effects lateral movement of the products. The directrix is inclined relative to the direction of movement of the products, and a device is provided for bypassing movement of the ejection device with respect to the directrix so that the ejection device will move independently of the movement of the products.

23 Claims, 7 Drawing Figures

INSERTION APPARATUS

BACKGROUND OF THE INVENTION

1. Field of the Invention

The invention relates to an insertion apparatus for inserting various continuously supplied products into containers with ejection means arranged to move parallel to the products over an endless belt. According to the invention, the ejection movement of a piston of the ejection means is provided by a directrix which is inclined relative to the direction of movement of the products. The ejection means can be made to bypass the directrix by a switching mechanism.

2. Description of Prior Art

Apparatus of the above types are generally known and are used in connection with continuous packaging apparatus which, for example, comprise a product chain with product compartments positioned thereon in which products such as vials, bottles, soap bars, etc., are positioned. Containers such as folded containers in which the products are to be inserted are provided and moved parallel to the product chain. Insertion occurs by means of ejection pistons which are moved along a principal movement direction by means of chain conveyors which are also moved parallel to the product chain. Insertion occurs by providing the ejection piston with a component of movement along a direction perpendicular to the principal direction of movement. To accomplish this, in one apparatus known in the art, a directrix is provided which is inclined with respect to the principal movement direction and is mounted on the product chain. In certain cases it becomes necessary that the product not be inserted within the container. This is because there is no container positioned opposite the product to receive it, or because such a container is positioned in a faulty manner. In this case the piston must not be guided and caused to move by the directrix. In the known apparatus a pivotable lever is provided, which, as desired, is either mounted on the directrix or can be so aligned, such that the pistons do not move along the directrix but rather are moved past the directrix without any component of force being impressed on the piston in the direction of ejection.

Such a lever is disadvantageous insofar as the pistons which are initially moved only along the principal direction of movement meet the lever with a given pressure and then are suddenly reversed away from the lever and receive an ejection component of force. This involves a damaging impact, which can result in increased wear on the apparatus, which in turn reduces the reliability of the apparatus. In order to increase the operational reliability of the apparatus, and in particular, to reduce the risk of damage resulting from vibrations and the like which occur during the insertion of products into containers, the directrix is spring supported, such that with an insertion disturbance which occurs when the products jam either during insertion or when in the container, which exert an excessive force on the directrix, the ejector undergoes a slight relative movement to contact the ejector with the container and the machine is disconnected. A disadvantage of such an apparatus is that the apparatus tends to continue somewhat even after disconnection has occurred, such that the ejector continues its movement somewhat due to its contact with the directrix to immediately cause damage to occur. Furthermore, the directrix undergoes a pivoting movement such that the force necessary to remove the apparatus from the insertion location varies in accordance with the position of the insertion location with respect to the length of the directrix.

SUMMARY OF THE INVENTION

It is, therefore, an object of the invention to overcome each of the above disadvantages and to provide a surer, more reliable and dependable apparatus.

According to the invention, a stationary guide curve is provided to guide the ejection means. By virtue of the inventive arrangement, the direction of movement of the ejection means is reversed in a soft and vibration-free manner, without impulse, in front of the directrix. The apparatus is reliably controlled over the entire reversal process such that impulses to the ejection means and/or impulses to the guide curve drive rollers are reliably prevented.

According to the inventive apparatus, a further disadvantage associated with prior art apparatus is avoided in that according to a preferred embodiment, the guide curve is positioned on the direction reversing axle of the advancement means of the ejection means; the means may include a chain mounted on a chain wheel axle. With prior apparatus, a pivotable lever had to be mounted stationary in the housing of the apparatus. As a result, the chains are further tensioned such that the movement conditions vary, which can lead to poorer operation of the apparatus. According to the inventive arrangement, the movement conditions do not chage during subsequent tensioning of the chains between the ejection apparatus and/or the guide portions, such as guide rollers, and the guide curves.

Yet a further advantage according to the invention is that the guide curve is formed as an outer curve on the exterior or outer portion of the cylinder of a guide cylinder. In this case the cam rollers of the apparatus are already being directed during direction reversal, which leads to a smoother run. Besides this, flatter insertion curves result for products of the same outside dimensions, since the insertion movement of the insertion ejection apparatus through the guide curve can already have occurred in the reversal zone of the transport means for the ejection means. The lever present in apparatus made according to the state of the art require a costly switching mechanism. In comparison, by virtue of the inventive arrangement, one achieves a reduction in the number of parts as well as a simpler arrangement from a constructional point of view.

According to a preferred embodiment, the movement of the insertion ejection apparatus is vibration-free with respect to the cam roller positioned within the guide curve, which is particularly true when the guide has a configuration defined by a fifth order polynomial. A particularly smooth and clean as well as stable guide which guarantees a good guidance is achieved when the guide is not formed out of flat bent material nor cast, but rather when it is milled in one piece. While in principle it can be provided that the guide curve may be linearly adjustable relative to the guide roller at the zone of the oncoming movement of the injection ejection apparatus, it is notable that according to a most preferred embodiment, the guide cylinder is arranged such that its axle is perpendicular to the direction of forward movement, and the guide curve is reversed in the direction of the directrix, beginning at a spaced initial zone running parallel to the direction of movement of the edges of the guide cylinder and wherein the cylinder is mounted to be adjustable on its axle. The movement of the cylinder, i.e., the pivoting or the linear movement can be made to occur with either a hydraulic or pneumatic fluid cylinder-piston apparatus or can be achieved electromagnetically. Naturally, pivoting may be achieved by other drive means as well.

The reliability and dependability sought according to the invention are further achieved according to the inventive apparatus, in that upon application of a force to the ejection means exceeding a preset limit value, the directrix releases and can be easily pivotable.

To achieve this, in contrast with systems provided by the prior art, in which the directrix is always spring mounted, according to the invention, the directrix is mounted so as to be freely movable when subjected to an excess pressure. This may, for example, be achieved by pivoting the directrix out of its normal guide position to a rest position. However, it can further be provided that the directrix is actively moved away from the ejection means after encountering an excess resistance pressure as a result of a small relative movement switch which initially affects the entire forward movement, such as by a fluid cylinder arrangement or an electromagnet. In both cases there is no further pressure exerted on the ejection means nor on the product being inserted during subsequent movement of the apparatus, so that no damage can occur.

According to yet another preferred aspect of the invention, the directrix is moved back to a rest or free position which is essentially parallel to its normal engagement position. As a result, the release pressure is essentially equal along all points along the directrix. After removal of the disturbance or interference, the directrix may then be manually returned to its normal position. To accomplish this simply, it is preferable to provide a apparatus having a release assembly having a release notch and a release cam, for example in the form of a roller mounted on ball-bearings, such that a lifter provided with a movable contact associated with a fixed contact functions to disconnect the apparatus when the lever has been lifted by virtue of a disturbance along the directrix.

BRIEF DESCRIPTION OF THE DRAWINGS

The invention will now be described with reference to the annexed drawings, given by way of example only, in which.

DESCRIPTION OF PREFERRED EMBODIMENTS

Figure 1:
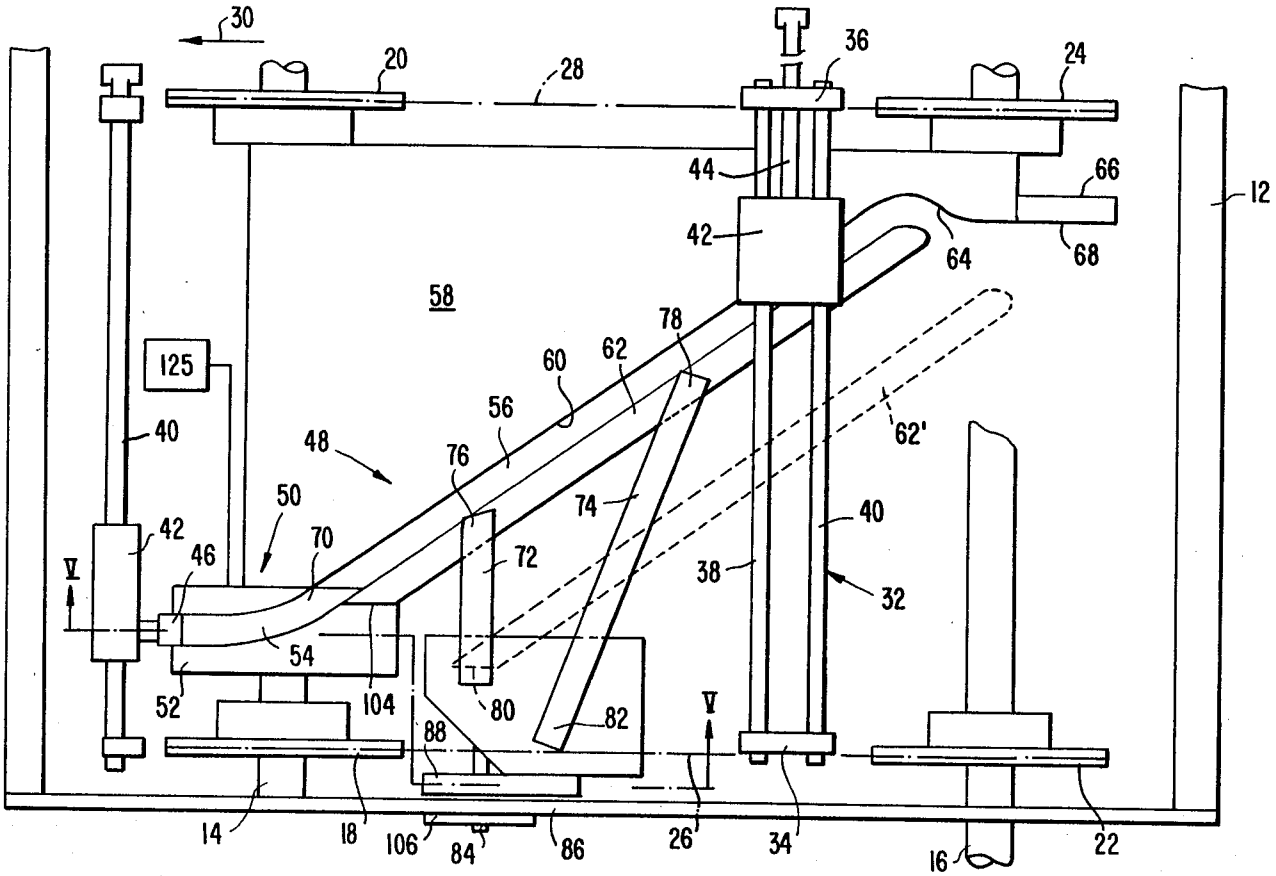
FIG. 1 illustrates one embodiment of the inventive apparatus for insertion of products in containers.

The inventive apparatus, according to one embodiment shown in FIG. 1, is housed in a casing 12. Chain wheel axles 14 and 16 are journalled at the ends into casing 12. Chain wheel axle 16 is driven by drive means and a motor (not shown). Spaced wheels 18, 20 and 22, 24 are each fixedly mounted on axles 14 and 16, respectively. Chains 26 and 28 are mounted on corresponding wheels 18, 22 and 20, 24, respectively. The chains are shown in chain lines in FIGS. 1, 4 and 5. Chain wheel axle 14 moves chain 28 in direction 30 (which delineates clockwise rotation of reel 20). in frame 12 and is securable such that by movement of chain wheel axle 14 in direction 30 the chains can be tensioned. Spaced insertion ejection carriers are mounted on the chains in a preselected, adjustable, spaced manner. Ejector carriers 32 comprise two stabilizers 34 and 36 which are secured directly to the chains. The ejector carriers further comprise two parallel guide shafts 38 and 40. An axially movable carrier block 42 is mounted to slide along each of shafts 38 and 40. Ejection or push rod 44 is mounted on carrier block 42 and moves together therewith. The pushing rod slidably extends through an opening in stabilizer 36, the opening being positioned between both of shafts 38 and 40 (see FIG. 1). A cam roller 46 is mounted at the lower end of carrier block 42 and extends radially with respect to axles 14 and 16 at each chain reversal zone. The apparatus of the invention is used in conjunction with a packaging apparatus in which products such as vials, bottles, etc. are packaged in containers. The products are conveyed by means of a product chain positioned parallel to and in front of chain 28. The product chain is not illustrated, and reference is herein made to U.S. Pat. No. 3,333,396, which illustrates such an apparatus, this document being incorporated herein by reference thereto. Cam roller 46 moves along a slide 48 as will be explained in greater detail below.

After reversal along chain wheels 22 and 24, carriers 32 move back towards wheels 18 and 20 behind the plane shown in FIG. 1. Guide cylinder 50 is journalled onto chain wheel axle 14 and has an outer casing 52 comprising a guide curve 54 adapted to seat and guide cam rollers 46 (see also FIG. 5), the cam surface being milled out of the surface of the casing. In the embodiment of guide cylinder 50 shown in FIGS. 1 and 2, guide curve 54 opens into a guide 56 which guides cam rollers 46 whereby guide 56 is formed in a portion of casing wall 58 and extends essentially along a straight inclined line portion 60. The guide is formed between straight line portion 60 and a directrix 62 arranged parallel to line portion 60 in a movable manner. Line portion 60 turns into a curved portion near chain wheel 24 and then from the beginning of wheel 24 the curvature of the line portion changes into a cut-away portion 64 configured as well as guide curve 54 in the form of a higher order polynomial, particularly a fifth order polynomial, which can be easily represented and which has found to ensure a smooth deflection of cam roller 46 without pushing with a slowly increasing acceleration of movement component parallel to e.g. shaft 40. This is because such a movement law provides small forces, momenta, especially small impetus due to small static burden and inertia forces. An ideal range function of such a polynomial could be $f(z)=10z^3-15z^4+6z^5$ with $0 \leqq z \leqq 1$. Casing wall portion 66 is secured to cut-away portion 64 so as to provide a guide surface 68 which is arranged essentially radially to chain wheel axle 16. Beneath drive axles 14 and 16 and under the plane of FIG. 1 (and therefore not visible in FIG. 1) slide 48 again initially comprises a curved guide surface for cam rollers 46 which return the moving insertion ejection apparatus along a movement path which is parallel to guide 56, before reaching the vicinity of guide cylinder 50, at which point it again curves such that cam roller 46 is moved along a direction perpendicular to the radius of axle 14.

Figure 3:
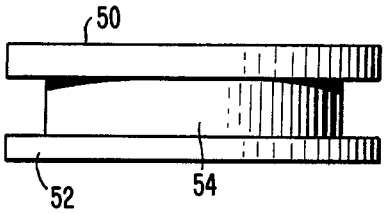
FIG. 3 illustrates the same cylinder as previously but when the injection ejector is in the free-running position.

When guide cylinder 50 is rotated by about 45° by means of an eccentrically mounted fluid cylinder or electromagnetic or other drive means (not shown in detail in FIG. 1, but illustrated by a block schematically therein) guide cylinder 50 presents a surface, as shown in the embodiment of FIG. 3, in which the guide surface appears straight while the curved cut-out 70 is moved aside as a result of the rotation of the cylinder.

Directrix 62 is mounted on two pivotable arms 72 and 74, pivotable along two pivot axes 76 and 78, respectively.

Pivot arms 72 and 74 are themselves journalled along journal axes 80 and 82. Pivot arms 72 and 74 are adapted such that the directrix is moved to an essentially parallel position 62' as a result of the movement of the pivot arms.

Figure 4:
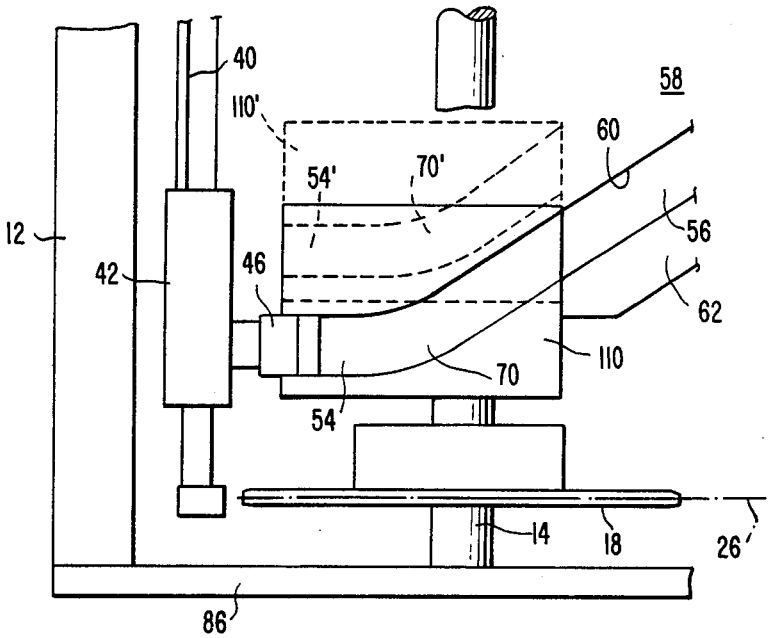
FIG. 4 is a detailed view of another embodiment of the apparatus which illustrates the reversal location in dashed-lines in the free-running position of the ejection means.

In the embodiment shown, journal axis 80 is located at the lower end of pivot arm 72 and comprises a toothed bevel wheel 81 which mates with another toothed bevel wheel 83 (FIG. 6) mounted on an axle 84 which is vertically aligned with respect to axis 80. Arm 74 is freely journalled both upon axis 82 and on axis 78. A disk 88 is mounted on axle 84 in the vicinity of front cover 86 of casing 12, which is provided at its outer periphery with a notch 90 (see FIG. 5), Projection or bearing 96 is biased into notch 90 by means of spring 92 though a lever 94 and locks into a preselected position on disk 88. As a result, directrix 62 in the embodiments of FIGS. 1 and 4 is held over axle 84, both toothed wheels, axle 80 and pivot arm 72. A movable contact 98 is mounted on lever 94 which operates in conjunction with fixed contact 100 (see FIG. 5).

The embodiment described in FIGS. 1, 2, 3 and 5 operates as follows:

Insertion ejection carrier 32 is moved by means of chains 26 and 28 on chain wheel 16, beneath the plane of FIG. 1 and in the direction of the return plane on axle 14 such that cam roller 46 enters a cam surface guide curve 54 of guide cylinder 50 at location 102 (see FIG. 5) and is guided during the further movement of ejector carrier around guide cylinder 50. In the embodiment of the guide cylinder and guide curve of FIGS. 1 and 2, cam roller 46 is moved over cut-out 70 of guide curve 54 and continues along guide 56 between directrix 62 and line portion 60. Carrier block 42, together with push rod 44, is moved along shafts 38 and 40 such that a product to be packaged into containers which is being moved along a product chain (not shown) at the same velocity as the insertion injection apparatus can be inserted into containers such as boxes by movement of the piston. Push rod 44 is forced into the box or container and, as it passes over section 64 is retracted from the container. As insertion ejection apparatus 32 is moved around chain wheel axle 16, cam roller 46 is moved along guide surface 68. Finally, cam roller 46 is returned along the rear plane, described above, along guide means, which are not illustrated in detail, to the exit point shown on the left side of FIG. 1, while at the same time push or piston rod 44 is retracted to the position shown.

Figure 2:
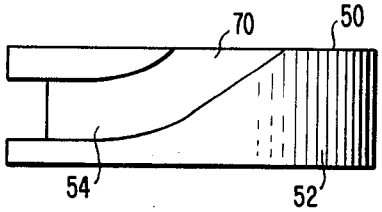
FIG. 2 is a view illustrating the guide curve on the cylinder at the reversal location of the apparatus.

In the event of of a disruption or disturbance to the packaging machine, to that at a given location no product is advanced, or that no compartment is available, or that there is no container present, guide cylinder 50 is moved by a hydraulic cylinder or an electromagnetic cylinder, or the like (shown in a single black box in FIG. 1, which represents them as being conventional), out of the position shown in FIGS. 1 and 2, and into the position shown in FIG. 3 in which it is pivoted in a clockwise direction. In this position of guide cylinder 50 and guide curve 54, cam roller 46 is not engaged in guide 56 but is instead guided along a back edge of directrix 62 under guide 56 such that push rod 44 does not move along the path provided by guide 56, and wherein the ejection means is moved towards axle 16 without supplying a vertical component to the piston during the movement of the apparatus. As a result, no insertion of the product into the container occurs. Afterwards, in such a case, cam roller 46 is guided along and out of guide curve 54 at the location of FIG. 3, and guide cylinder 50 is once again moved back to its normal position shown in FIGS. 1 and 2.

Figure 5:
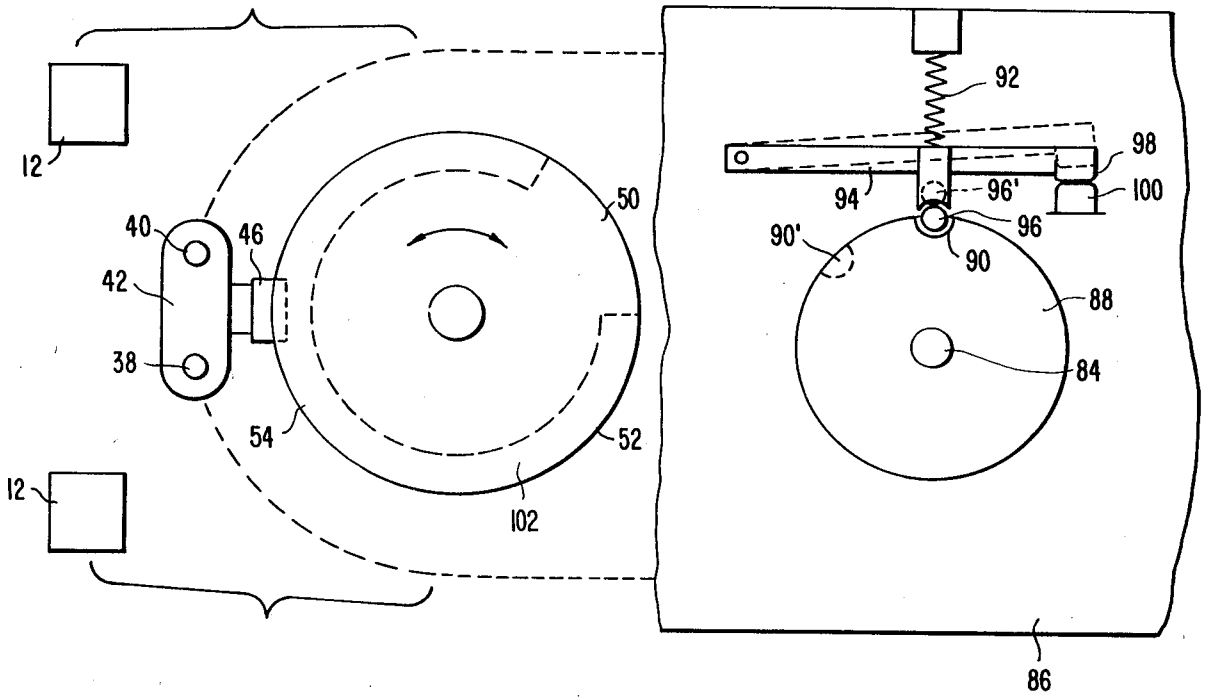
FIG. 5 is a view along line V—V of FIG. 1.
Figure 6:
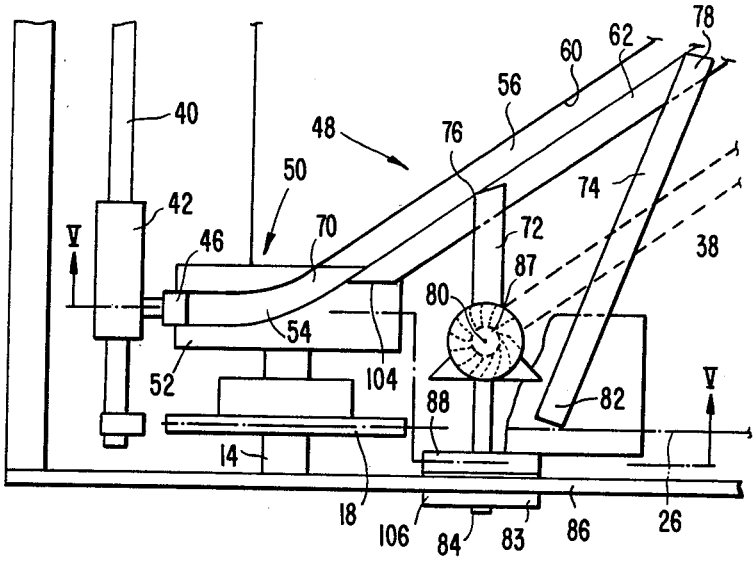
FIG. 6 is a partical view of FIG. 1 with some elements particularly broken away to show cooperation of axis 84 with axis 80 via toothed wheels 81, 83 in order to journal arm 72 and consequently to move directrix 62 in portion 62'.
Figure 7:
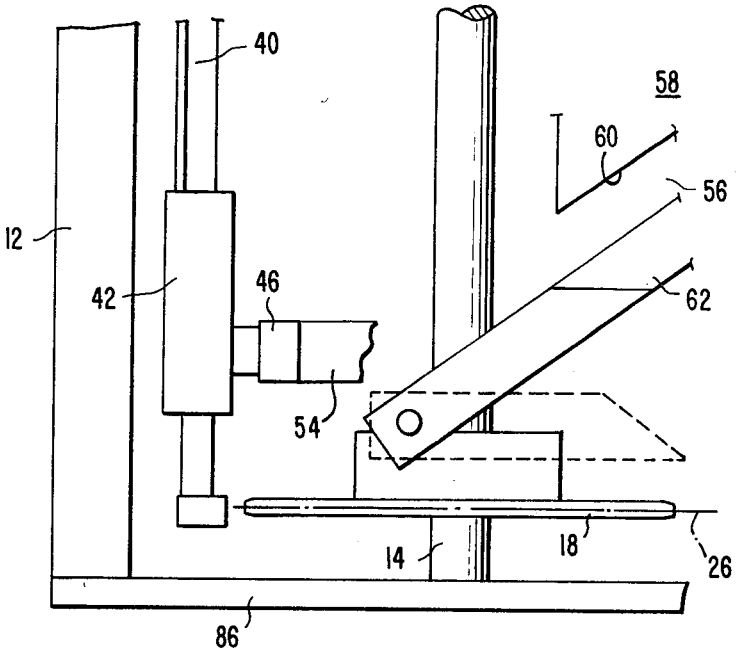
FIG. 7. PRIOR ART
FIG. 7 shows merely for information deflecting means of prior art, namely lever 51 as described on pages 1 and 2 of this specification.

When a disruption occurs during the movement of cam roller 46, together with the insertion movement of push rod 44 in guide 56, such as, for example, the insertion movement of push rod 44 is somehow hindered, a higher pressure is exerted on directrix 62 over movable carrier block 42 and cam roller 46. When this pressure exceeds the pressure exerted by spring 92 (FIG. 5), directrix 62 is moved out of its normal position shown in FIG. 1 and is forced to the position shown in dashed lines in FIG. 1. In so doing pivot arm 72 pivots around its axis 80 together with axle 84 which is mounted to pivot together with it, and with it disc 88 such that notch 90 is in position 90' shown in FIG. 5. Bearing 96 is likewise displaced out of notch 90 into position 96'. This causes lever 94 to be raised and thus breaks contact between contacts 98 and 100 in the example shown (see FIG. 5). Instead of breaking contact by means of the lifting of lever 94, contact could, instead, be established. As a result of the contact interruption which results when the lever is raised, the apparatus is stopped, such that the cause of the disruption can be eliminated. To continue operation, a hand wheel 106 positioned in front of cover 86 is used to reset disk 88 to its normal operating position. In this position bearing 96 is repositioned in notch 90 and directrix 62 is moved back to its operational position shown in solid lines in FIG. 1. The apparatus is then again ready for use. When an opposing force is exerted on push rod 44 by guide slot 56, in order to stop the push rod from proceeding, the force acts via block 42 on guide roller 46 to force guiding straight edge 62 into the position illustrated in dotted lines in FIG. 1. The straight edge guide 62 is supported on levers 72 and 74, which upon displacement of straight edge 62, are pivoted about their axes of rotation 80 and 82. Bevel gear 81, as shown in FIG. 6, is connected to shaft 80 and meshes at right angles with a second bevel gear 83, which is connected by shaft 84 to disk 88. When guiding straight edge 62 is forced sideways, shaft 80 rotates disk 88 via gears 81 and 83 and shaft 84, as illustrated in FIG. 6. As shown in FIG. 5, when disk 88 rotates, snap-in ball 96 is forced out of the snap-end groove 90 of disk 88, and acts against the force of spring 92 in order to open switch 98, 100. When this switch is opened the equipment is shut down.

FIG. 4 illustrates a further embodiment of the inventive apparatus in cross-section wherein the same elements illustrated in connection with the previous embodiment are identified by the same reference numerals. In this embodiment, instead of pivotably journalled guide cylinder 50, a linearly movable guide block 110 is provided which is milled in the same manner as guide cylinder 50 with a guide curve 54 having curved position 70.

In the configuration shown in FIG. 5, cam roller 46 is moved along guide curve 54 in guide 56 between directrix 62 and line portion 60. In the position of block 110 shown in dashed lines in FIG. 4, the block is displaced out of the movement path of cam roller 46, for example by means of a fluid cylinder, a magnet, or the like, such that cam roller 46 moves freely behind block 110 and directrix 62 such that push rod 44 is not activated.

Although the invention has been described with respect to particular means, materials and embodiments, it is to be understood that the invention is not limited to the particulars disclosed but extends to all equivalents included within the claims.

What is claimed is:

1. An insertion apparatus for ejecting products which are continuously supplied into containers, said apparatus comprising:

(a) ejection means arranged to move parallel to said products along an endless conveyor system;

(b) a directrix adapted to guide said ejection means laterally shift to said products, said directrix being inclined relative to the direction of movement of said product line; and (c) means for bypassing the movement of said ejection means relative to said directrix whereby said ejection means moves independently thereof, said by passing means including a guide curve adapted to guide the movement of said ejection means relative to said directrix, said guide curve being defined by a groove formed in a cylinder casing mounted on a guide cylinder, said guide cylinder being rotatable, whereby rotation of said guide cylinder from a normal operating position will cause said ejection means to bypass said directrix.

2. The apparatus as defined by claim 1 wherein said guide curve is configured such that said ejection means is transported in a vibration-free manner through said guide curve.

3. The apparatus as defined by claim 1 wherein the configuration of said guide curve is defined by a higher order polynomial.

4. The apparatus as defined by claim 3 wherein the configuration of said guide curve is defined by a fifth order polynomial.

5. The apparatus as defined by claim 1 wherein said guide curve is milled out of a single element.

6. The apparatus as defined by claim 1 wherein said guide cylinder is mounted along an axis perpendicular to the direction of movement of said ejection means, said guide curve comprising means for reversing the direction of motion as said ejection means returns after ejecting said product, along a direction parallel to the edge of said guide cylinder, towards said directrix.

7. The apparatus as defined by claim 6 wherein said guide cylinder is rotatable through an angle of about 45°.

8. The apparatus as defined by claim 1 wherein said guide curve is linearly moveable and is adapted to guide a cam roller mounted on said ejection means toward said directrix.

9. The apparatus as defined by claim 1 further comprising means for adjusting the position of said guide curve.

10. The apparatus as defined by claim 9 wherein said means for adjusting the position of said guide curve includes a hydraulic cylinder-piston arrangement.

11. The apparatus as defined by claim 12 wherein said means for adjusting the position of said guide curve comprises an electromagnetic system.

12. The apparatus as defined by claim 1 wherein said directrix is mounted whereby said directrix is released and freely pivotable from its normal position as a result of an excessive force being exerted upon said ejection means.

13. The apparatus as defined by claim 12 further comprising means for pivoting said directrix.

14. The apparatus as defined by claim 13 wherein said means for pivoting said directrix is a fluid cylinder-piston system.

15. The apparatus as defined by claim 13 wherein said means for pivoting said directrix comprises an electromagnetic system.

16. The apparatus as defined by claim 14 further comprising maintenance means for maintaining said directrix in its normal operating position, said maintenance means permitting the release of said directrix when said directrix is subjected to an excess pressure.

17. The apparatus as defined by claim 16 wherein said maintenance means comprises a maintenance notch and a maintenance projection adapted to seat within said notch, and wherein said directrix is associated with said projection whereby when excessive force is exerted on said directrix, said directrix will be moved out of a normal position and will pivot said notch, thereby unseating said projection from within said notch.

18. The apparatus as defined by claim 17 wherein said projection is spring biased within said notch.

19. The apparatus as defined by claim 18 wherein said projection is a ball bearing.

20. The apparatus as defined by claim 16 wherein said maintenance means is positioned adjacent to a front plate of a frame in which said apparatus is mounted.

21. The apparatus as defined by claim 16 further comprising a lever associated with said maintenance means, said lever comprising a movable first electrical contact, said lever being mounted relative to a second electrical contact whereby when said directrix is moved, said lever will be raised or lowered by displacement of a projection positioned within a pivotable notch, thereby selectively establishing electrical contact between each of said first and second electrical contacts.

22. The apparatus as defined by claim 1 wherein said directrix is movable to an inactive position which is essentially parallel to the active position of said directrix.

23. The apparatus as defined by claim 22 further comprising two pivot arms adapted to pivotably support said directrix at spaced points along said directrix, and wherein each of said pivot arms is journal-mounted.

* * * * *